United States Patent [19]

Bradshaw

[11] 3,981,805

[45] Sept. 21, 1976

[54] HIGH TEMPERATURE RADIOISOTOPE CAPSULE

[75] Inventor: George B. Bradshaw, San Diego, Calif.

[73] Assignee: The United States of America as represented by the Secretary of the Air Force, Washington, D.C.

[22] Filed: Sept. 13, 1972

[21] Appl. No.: 287,160

Related U.S. Application Data

[63] Continuation-in-part of Ser. No. 846,996, July 28, 1969.

[52] U.S. Cl. ..... 250/493

[51] Int. Cl.[2] ..... G21G 4/00

[58] Field of Search ..... 250/106 S, 493, 496; 176/67, 83, 81; 136/202

[56] References Cited

UNITED STATES PATENTS

| | | | |
|---|---|---|---|
| 3,262,860 | 7/1966 | Zebroski | 176/81 |
| 3,533,913 | 10/1970 | Botts et al. | 250/106 S |
| 3,569,714 | 3/1971 | Anderson | 250/106 S |
| 3,659,107 | 4/1972 | Selle | 250/106 R |
| 3,723,742 | 3/1973 | Aranguren et al. | 176/67 X |

FOREIGN PATENTS OR APPLICATIONS

| | | | |
|---|---|---|---|
| 1,185,001 | 3/1970 | United Kingdom | 250/106 S |

*Primary Examiner*—Harvey E. Behrend
*Attorney, Agent, or Firm*—Joseph E. Rusz; Jacob N. Erlich

[57] ABSTRACT

A high temperature radioisotope capsule made up of three concentric cylinders, with the isotope fuel located within the innermost cylinder. The innermost cylinder has hemispherical ends and is constructed of a tantalum alloy. The intermediate cylinder is made of a molybdenum alloy and is capable of withstanding the pressure generated by the alpha particle decay of the fuel. The outer cylinder is made of a platinum alloy of high resistance to corrosion. A gas separates the innermost cylinder from the intermediate cylinder and the intermediate cylinder from the outer cylinder.

6 Claims, 3 Drawing Figures

FIG. 1
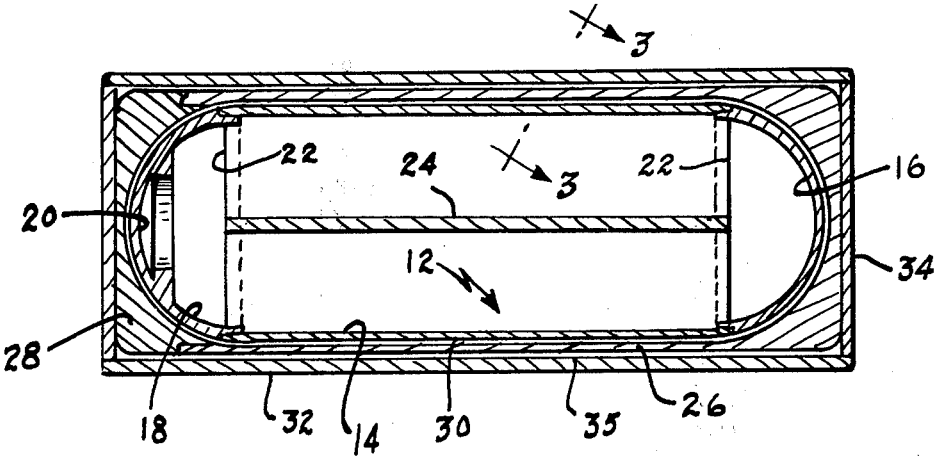
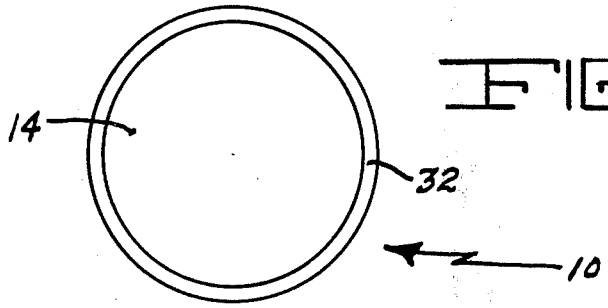
FIG. 2
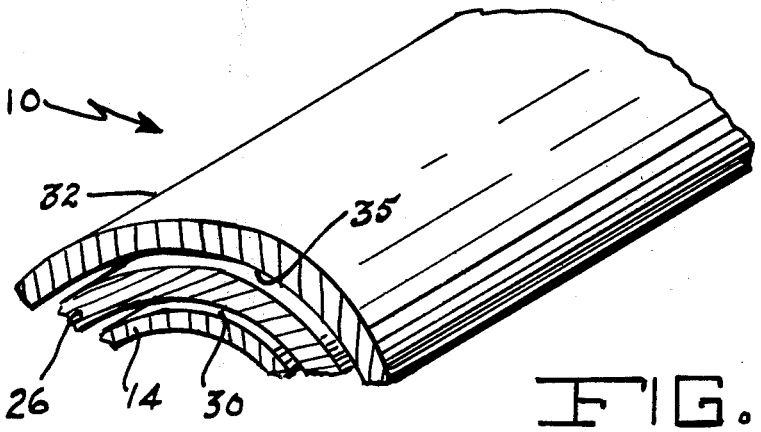
FIG. 3

HIGH TEMPERATURE RADIOISOTOPE CAPSULE

BACKGROUND OF THE INVENTION

This application is a continuation-in-part of Ser. No. 846,996 filed July 28, 1969.

This invention relates generally to capsules for containing an isotope heat source and, more particularly, to a capsule which is designed to contain a radioisotope heat source above 1800°F, or survives re-entry temperatures above 2500°F.

The majority of rocket propulsion rocket systems in current use utilize chemical energy to provide the heat for the working fluid. These systems are characterized by relatively low thruster specific weights and specific impulse. Various high specific impulse electrical propulsion systems are currently being developed, including arc jets, plasma jets and ion engines. While these systems have very high specific impulse, the total weight of the power supply and engine is also relatively high. It is therefore quite obvious that neither the chemical or electrical propulsion systems can simultaneously provide both high specific impulse and low propulsion system weight.

It has therefore been found that a radioisotope rocket engine for space vehicles is most desirable since it provides a relatively high specific impulse with a relatively low specific thruster weight. The radioisotope rocket engine comprises essentially one or more encapsulated radioisotope heat sources located in a geometric center of the rocket engine and surrounded by a housing forming a flow channel or fluid passage around the capsule. One end of the housing is connected to a propellant line extended from a propellant storage tank which is preferably filled with a fluid such as hydrogen ($H_2$) or other suitable propellants such as $N_2H_4$, $NH_3$ or $H_2O$. The fluid in the propellant storage tank preferably receives sufficient heat to generate vapor pressure within the storage tank which is sufficient to force the fluid out of the tank and through the fluid passage, where heat is transferred to the fluid by conduction through the walls of the capsule and then by convection and radiation to the gas which is formed by vaporization of the working fluid at the entrance end of the thruster. The gas is superheated to higher and higher temperatures as it flows through the engine and out of a nozzle formed at the opposite end of the housing.

Heretofore, the capsule design for such a radioisotope heat source has failed to meet the aerospace safety criteria which dictates complete fuel containment during re-entry into earth's atmosphere and ground impact at terminal velocity. To date, no radiosotope capsule has been designed to contain an isotope heat source above 1800°F, or survive re-entry temperatures above 2500°F. Previously, capsules have been fabricated from super alloys, however, they failed to provide reliable containment above 1800°F or withstand high re-entry temperatures.

SUMMARY OF THE INVENTION

The high temperature radioisotope capsule of this invention overcomes the problems heretofore encountered and as set forth hereinabove.

The capsule of this invention can be employed for almost any system designed for an isotope heat source. For example, the most immediate uses for this invention include:

1. heaters for decomposing or raising the temperature of fuels used in thruster engines or space systems;
2. catalyst heaters for life control systems;
3. heat sources for thermoelectric or thermionic space power systems; and
4. special purpose uses such as propellant vaporizers, environmental control, or miscellaneous heater applications.

The radioisotope capsule of this invention is made up basically of three concentric cylinders mated together, each with a distinctly different function. The isotope fuel such as plutonium is located in the innermost cylinder which is fabricated from a tantalum alloy, known to be compatible with the fuel form at temperatures up to 2000°F. Because of the low thermal conductivity of the fuel, perpendicular axial heat conduction fins are located within the fuel liner to limit the center line temperature of the fuel to around 2200°F.

The innermost cylinder or fuel liner is inserted into a second cylinder which is designed to withstand the pressure generated by the alpha particle decay of the fuel for up to 4 years with minimal strain. This second cylinder or pressure-vessel is fabricated from a molybdenum alloy which provides resistance to the high impulsive forces, such as those encountered during impact onto a hard surface.

The remaining outer structure is a corrosion barrier which protects the inner refractory alloy members during pre-launch, operation, and re-entry (up to 3000°F), and post impact environments. A platinum alloy which includes 20 percent rhodium is used for this structure because it provides the necessary chemical protection, structural integrity and is readily fabricated. The materials utilized in the capsule of this invention are resistant to diffusion for long periods of time at 2000°F.

The design of this capsule further utilizes a special elliptical end cap shape to reduce joint stresses and the liner configuration employs internal baffels for minimizing temperatures down the center of different fuel forms. Besides the unique features set forth above the capsule of this invention also reduces thermal resistance between the various members or cylinders by utilizing a gas, preferably helium, between each assembly to improve the heat transfer. The middle structure is electron beam welded and a special plug is provided in the opposite end for back filling and sealing the helium atmosphere.

It is therefore an object of this invention to provide a high temperature radioisotope capsule which is lightweight, compact and meets all aerospace safety criteria.

It is another object of this invention to provide a high temperature radioisotope capsule which utilizes a platinum alloy which includes 20 percent rhodium for the outer high temperature corrosion resistant cladding.

It is a further object of this invention to provide a high temperature radioisotope capsule which utilizes a molybdenum alloy for the pressure vessel material.

It is still a further object of this invention to provide a high temperature radioisotope capsule which utilizes elliptical shaped end caps to reduce stresses in the capsule end cap and weld joints and which utilizes self-aligning internal axial conduction fins to minimize fuel temperature gradients.

It is still another object of this invention to provide a high temperature radioisotope capsule which utilizes helium between each member to reduce temperature drops and gradients along the capsule surface.

It is still a further object of this invention to provide a high temperature radioisotope capsule which utilizes conventional, currently available components that lend themselves to standard mass producing manufacturing techniques.

For a better understanding of the present invention, together with other and further objects thereof, reference is made to the following description taken in connection with the accompanying drawing and its scope will be pointed out in the appended claims.

DESCRIPTION OF THE DRAWING

FIG. 1 is a side elevational view of the radioisotope capsule of this invention shown in cross section;

FIG. 2 is an end view of the radioisotope capsule of this invention; and

FIG. 3 is a cross sectional view of the radioisotope capsule of this invention taken along 3—3 of FIG. 1.

DESCRIPTION OF THE PREFERRED EMBODIMENT

The radioisotope capsule 10 of this invention is best shown in FIG. 1; however, reference will be made interchangeably to FIGS. 1 and 3 during the detailed description of this invention set forth hereinbelow.

The radioisotope capsule 10 of this invention is made up of an innermost cylinder or a liner 12. This liner 12 is made of a plurality of sections 14, 16, 18 and 20, all secured to one another by any suitable securing method such as electron welding. The cylindrical section 14 of liner 12 has end caps 16 and 18 secured thereto, with end cap 18 further having outer section 20 mounted thereon. The isotope fuel (not shown) is located in the central portion of the innermost cylinder 12. The cylinder 12 is fabricated from a tantalum alloy which is about 10 percent tungsten by weight with the balance substantially all tantalum. This innermost cylinder 12 is chemically compatible with the isotope fuel source at temperatures up to 2,000°F. Perpendicular axial or radial heat conduction fins 22 are secured to the end caps 16 and 18 of the innermost cylinder 12 in order to limit the center line temperature of the fuel to about 2,200°F. A baffle or plurality of baffles 24 secured to the fins 22 are utilized for minimizing the temperatures down the center of different fuel forms.

The fuel liner or innermost cylinder 12 is located within a second cylinder 26 which is designed to withstand the pressure generated by the alpha particle decay of the fuel for up to 4 years with minimal strain. The second cylinder 26 is made of any suitable molybdenum alloy which provides resistance to the high impulsive forces such as those encountered during impact onto a hard surface. An example of such an alloy would be Mo, 0.5 percent Ti, 0.08 percent Zr, 0.015 percent C. The second cylinder 26 utilizes an elliptical end cap 28 secured to the cylinder 26 by any suitable securing method such as by electron welding. There is a space 30 located between the first cylinder or liner 12 and the second cylinder 26 which is filled with a suitable gas such as helium to improve the heat transfer, qualities of the capsule. The elliptical end cap 28 when in place seals the helium in between cylinder 12 and cylinder 26.

The outer structure having end caps 34 encases the second cylinder 26 and provides a corrosion barrier which protects the inner alloy members during prelaunch, operation, or re-entry (at temperatures up to 3,000°F) and post impact environments. This outer structure 32 is made of a platinum alloy which contains 20 percent by weight of rhodium and provides the necessary chemical protection and structural integrity. There is a space 35 located between the second cylinder 26 and the outer structure 32 which is also filled with a suitable gas such as helium.

The capsule 10 of this invention dissipates the energy released by the radioactive decay of the fuel in the form of heat. In use, tubes (not shown) are coiled around the outside of the capsule and heat is transferred to vapor which is passed through the tubes. The heat decomposes this vapor which is subsequently exhausted through nozzles to provide thrust.

The primary advantages of the radioisotope capsule of this invention are that it can operate continuously at temperatures of 2,000°F, for at least 2 years, and that the capsule is lightweight, compact, and meets all aerospace safety criteria. Additionally, it is believed that this invention is the first of its type to employ a molybdenum base alloy pressure vessel and platinum-rhodium cladding. Besides the unique features set forth hereinabove the design of the capsule of this invention reduces thermal resistance between the various members by utilizing helium gas between each structure to improve the heat transfer.

Although the invention has been described with reference to a particular embodiment, it will be understood to those skilled in the art that the invention is capable of a variety of alternative embodiments within the spirit and scope of this invention.

I claim:

1. A high temperature radioisotope capsule comprising a first innermost cylinder, said cylinder having at least one radial heat conduction fin mounted therein, a second cylinder surrounding said first cylinder, a first space separating said first cylinder from said second cylinder, a gas located in said space, an outer structure encasing said second cylinder, a second space separating said second cylinder from said outer structure and a gas located in said second space.

2. A high temperature radioisotope capsule as defined in claim 1 wherein said first cylinder is made from a tantalum alloy.

3. A high temperature radioisotope capsule as defined in claim 2 wherein said outer structure is made from a platinum alloy.

4. A high temperature radioisotope capsule as defined in claim 3 wherein said gas in said first and second space is helium.

5. A high temperature radioisotope capsule as defined in claim 4 wherein said tantalum alloy includes substantially 10 percent tungsten.

6. A high temperature radioisotope capsule as defined in claim 5 wherein said platinum alloy includes substantially 20 percent rhodium.

* * * * *